US005609142A

United States Patent [19]

Osanai

[11] Patent Number: 5,609,142

[45] Date of Patent: Mar. 11, 1997

[54] FUEL-VAPOR TREATMENT METHOD AND APPARATUS FOR INTERNAL COMBUSTION ENGINE

[75] Inventor: Akinori Osanai, Susono, Japan

[73] Assignee: Toyota Jidosha Kabushiki Kaisha, Aichi, Japan

[21] Appl. No.: 548,887

[22] Filed: Oct. 26, 1995

[30] Foreign Application Priority Data

Nov. 21, 1994 [JP] Japan ..... 6-286493

[51] Int. Cl.[6] ..... F02M 37/04

[52] U.S. Cl. ..... 123/520; 123/357

[58] Field of Search ..... 123/516, 518, 123/519, 520, 521, 198 D

[56] References Cited

U.S. PATENT DOCUMENTS

| | | | |
|---|---|---|---|
| 4,961,412 | 10/1990 | Furuyama | 123/357 |
| 5,323,751 | 6/1984 | Osanai et al. . | |
| 5,445,133 | 8/1995 | Nemoto | 123/520 |
| 5,465,703 | 11/1995 | Abe | 123/520 |
| 5,469,832 | 11/1995 | Nemoto | 123/520 |
| 5,474,049 | 12/1995 | Nagaishi | 123/520 |
| 5,476,081 | 12/1995 | Okawa | 123/520 |

FOREIGN PATENT DOCUMENTS

| | | |
|---|---|---|
| 4-72453 | 3/1992 | Japan . |
| 5-340315 | 12/1993 | Japan . |

*Primary Examiner*—Carl S. Miller
*Attorney, Agent, or Firm*—Kenyon & Kenyon

[57] ABSTRACT

A fuel-vapor treatment method and apparatus for an internal combustion engine, wherein when the density of fuel vapor emitted directly from a fuel tank is higher than the density of fuel vapor emitted from a canister, provisions are made to prevent the density of the mixture of these vapors purged into an intake passage from varying substantially, thereby suppressing perturbations in air-fuel ratio. When purge execution time becomes long, the energization of a solenoid valve used to control the amount of purge gas from the canister is limited to keep the maximum/minimum amount of purge gas or the amount of change thereof within a prescribed range. This serves to suppress the variation in purge gas amount, and hence the variation in vapor density, that may occur during a transition from idling to driving (in the increasing direction of the purge gas amount) or during a transition from driving to idling (in the decreasing direction of the purge gas amount).

6 Claims, 17 Drawing Sheets

FUEL-VAPOR TREATMENT METHOD AND APPARATUS FOR INTERNAL COMBUSTION ENGINE

BACKGROUND OF THE INVENTION

1. Field of the Invention

The present invention relates to a fuel-vapor treatment method and apparatus for an internal combustion engine, wherein, to prevent air pollution and fuel loss, fuel vapor (hereinafter called the vapor) emitted from a fuel tank is temporarily stored and then released into an intake system in accordance with the engine operating condition.

2. Description of the Related Art

Generally, in prior known fuel-vapor treatment methods and apparatus, fuel vapor is adsorbed onto an adsorbent, such as activated charcoal, contained in a canister, and during engine operation, the adsorbed vapor is desorbed and released into an intake system by utilizing the negative pressure created by engine intake stroke (this process is hereinafter called the "canister purge"). Control of the purge is performed by using a solenoid valve installed in a purge passage communicating between the canister and an intake passage downstream of the throttle valve, the solenoid valve being controlled to open or close the purge passage depending on the engine operating condition.

More specifically, when the engine operating condition has passed from an operating range where purge is not performed (low load, low rpm range) to an operating range where purge is performed (high load, high rpm range), the solenoid valve is opened. Conversely, when the engine operating condition has passed from the operating range where purge is performed to the operating range where purge is not performed, the solenoid valve is closed. During purging, the duty cycle of the solenoid valve is controlled to control the purge gas amount in accordance with the engine operating condition. In a commonly employed method for such duty cycle control, control is performed so that a prescribed purge gas amount is obtained proportional to the intake air amount, that is, the purge ratio (the ratio of the purge gas amount to the intake air amount) is maintained constant. For the above prior art, refer, for example, to Japanese Patent Unexamined Publication No. 4-72453 (corresponding U.S. Pat. No. 5,323,751).

However, in the intake-air-amount-proportional purge as described above, no serious consideration has been given to the density of vapor to be purged into the intake passage. That is, the vapor actually charged into the intake passage through the solenoid valve includes not only the vapor from the canister but also the fuel vapor being emitted directly from the fuel tank. The density of the vapor purged into the intake passage is therefore determined by the tank vapor, the canister vapor, and the purge air amount which is the amount of atmosphere drawn into the canister. While the canister vapor amount increases in proportion to the purge air amount, the tank vapor amount tends to be held substantially constant regardless of the purge air amount.

Accordingly, when the density of the canister vapor is low and the density of the tank vapor is high, if the solenoid valve is operated to vary the purge gas amount, the density of the resulting mixture will vary greatly. More specifically, when the solenoid valve is operated toward an open position to increase the purge gas amount, only the canister vapor amount increases while the tank vapor amount remains constant. As a result, the overall density of the vapor mixture charged into the intake passage through the solenoid valve decreases because of the low density of the canister vapor; therefore, in a control operation for correcting the fuel injection amount based on the purge gas amount, the moment that the solenoid valve is operated toward its open position, the air-fuel mixture becomes lean, hence causing perturbations in the air-fuel ratio. On the other hand, when the solenoid valve is operated toward a closed position to decrease the purge gas amount, only the canister vapor amount decreases while the tank vapor amount remains constant. As a result, the overall density of the vapor mixture charged into the intake passage through the solenoid valve increases since the density of the canister vapor is low; therefore, in the control operation for correcting the fuel injection amount based on the purge gas amount, the moment that the solenoid valve is operated toward its closed position, the air-fuel mixture becomes rich, hence causing perturbations in the air-fuel ratio.

SUMMARY OF THE INVENTION

In view of the above situation, it is an object of the present invention to provide a fuel-vapor treatment method and apparatus for an internal combustion engine, wherein perturbations in air-fuel ratio are suppressed by providing means for preventing the density of the vapor mixture purged into the intake passage from varying substantially when the density of the fuel vapor being emitted directly from the fuel tank is high as compared to the density of the fuel vapor released from the canister. Thus, it is also an object of the present invention to improve the precision of air-fuel ratio control and to thereby contribute to exhaust gas purification.

To accomplish the above objects, according to the present invention, there is provided a fuel-vapor treatment method for an internal combustion engine equipped with a canister for temporarily adsorbing and storing fuel vapor emitted from a fuel tank for the engine, and a solenoid valve, installed in a purge passage communicating between the canister and an intake passage to the engine, for controlling a purge gas amount drawn into the intake passage through the purge passage, the method comprising the steps of: (a) correcting a fuel injection amount in accordance with the purge gas amount; (b) calculating a purge ratio, the ratio of the purge gas amount to an intake air amount for the engine, in accordance with operating conditions of the engine; (c) calculating, based on the purge ratio obtained in step (b), the duty cycle of a pulse signal used to control the operation of the solenoid valve; (d) making a judgement as to whether the fuel vapor emitted from the fuel tank and introduced into the intake passage directly through the solenoid valve is in a dense state as compared to the fuel vapor desorbed from the canister; and (e) limiting the duty cycle calculated in step (c) or the amount of change of the duty cycle to within a prescribed range when it is judged in step (d) that the fuel vapor from the fuel tank is in a dense state.

According to the present invention, there is also provided a fuel-vapor treatment apparatus for an internal combustion engine, comprising: a canister for temporarily adsorbing and storing fuel vapor emitted from a fuel tank for the engine; a solenoid valve, installed in a purge passage communicating between the canister and an intake passage to the engine, for controlling a purge gas amount drawn into the intake passage through the purge passage; fuel injection correcting means for correcting a fuel injection amount in accordance with the purge gas amount; purge ratio calculating means for calculating a purge ratio, the ratio of the purge gas amount to an intake air amount for the engine, in accordance with operating conditions of the engine; duty cycle calculating means for calculating, based on the purge ratio calculated by the purge ratio calculating means, the duty cycle of a pulse signal used to control the operation of the solenoid valve; density difference judging means for making a judgement as to whether the fuel vapor emitted from the fuel tank and introduced into the intake passage directly through the solenoid valve is in a dense state as compared to the fuel vapor desorbed from the canister; and duty cycle limiting means for limiting the duty cycle calculated by the duty cycle calculating means or the amount of change of the duty cycle to within a prescribed range when it is judged by the density difference judging means that the fuel vapor from the fuel tank is in a dense state.

In the fuel-vapor treatment method and apparatus for an internal combustion engine according to the invention, as described above, when the density of the fuel vapor emitted from the fuel tank and introduced into the intake passage direction through the solenoid valve is higher than the density of the fuel vapor desorbed from the canister, the duty cycle of the solenoid valve or the amount of change of the duty cycle is limited to within a prescribed range. By thus limiting the operation of the solenoid valve within a prescribed range, the purge gas amount is limited to within a prescribed range, as a result of which the variation in vapor density caused by the variation of the purge gas amount is suppressed, hence reducing perturbations in air-fuel ratio when performing control to correct the fuel injection amount in accordance with the purge gas amount. Further, by limiting the amount of change of the duty cycle to within a prescribed range, the change of the purge gas amount becomes gradual and stabilized, as a result of which the vapor density is stabilized, ensuring consistent air-fuel ratio when performing control to correct the fuel injection amount in accordance with the purge gas amount.

BRIEF DESCRIPTION OF THE DRAWINGS

Further features and advantages of the present invention will be apparent from the following description with reference to the accompanying drawings, in which.

DESCRIPTION OF THE PREFERRED EMBODIMENTS

The preferred embodiments of the present invention will be described below with reference to the accompanying drawings.

Figure 1:
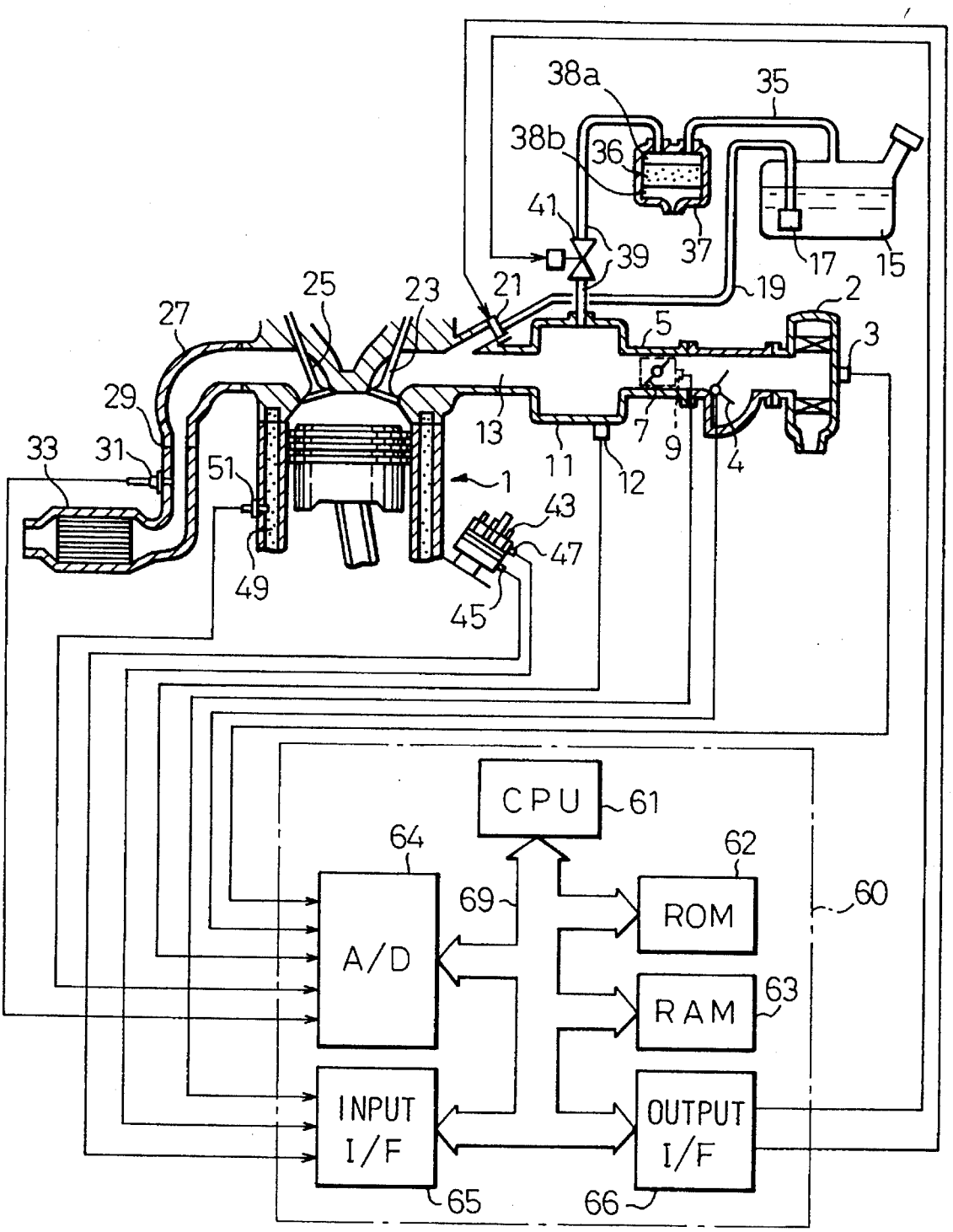
FIG. 1 is a diagram showing the general construction of an electronically controlled fuel injection-type internal combustion engine equipped with a fuel-vapor treatment apparatus according to one embodiment of the present invention.

FIG. 1 is a diagram showing the general construction of an electronically controlled fuel injection-type internal combustion engine equipped with a fuel-vapor treatment apparatus according to one embodiment of the present invention. Air necessary for combustion in the engine 1 is filtered through an air cleaner 2, and introduced through a throttle body 5 into a surge tank (intake manifold) 11 for distribution to an intake pipe 13 for each cylinder. The amount of intake air is measured by an air flow meter 4 and regulated by a throttle valve 7 provided in the throttle body 5. The opening angle of the throttle valve 7 is detected by a throttle angle sensor 9. The intake air temperature is detected by an intake air temperature sensor 3. Further, the intake manifold pressure is detected by a vacuum sensor 12.

On the other hand, the fuel stored in a fuel tank 15 is drawn by a fuel pump 17, passed through a fuel pipe 9, and injected into the intake pipe 13 through a fuel injector valve 21. The air and fuel thus supplied are mixed together in the intake pipe 13, and the mixture is drawn through an intake valve 23 into the cylinder 1, that is, into the engine body. In the cylinder 1, the air/fuel mixture is first compressed by the piston, and then ignited by an igniter or a spark plug and burned, causing a rapid pressure rise and thus producing power.

An ignition distributor 43 is provided with a reference position detection sensor 45 which generates a reference position detection pulse for every 720-degrees of CA rotation of its shaft measured in degrees of crankshaft angle (CA), and a crankshaft angle sensor 47 which generates a position detection pulse for every 30-degrees of CA. The engine 1 is cooled by a coolant introduced into a coolant passage 49, and the coolant temperature is detected by a coolant temperature sensor 51.

The burned air/fuel mixture is discharged as exhaust gas into an exhaust manifold 27 through an exhaust valve 25, and introduced into an exhaust pipe 29. The exhaust pipe 29 holds an $O_2$ sensor 31 for detecting oxygen concentration in the exhaust gas. The exhaust system further downstream holds a catalytic converter 33 which contains a three-way catalyst that promotes the oxidation of unburned constituents in the exhaust gas and the reduction of nitrogen oxides at the same time. The exhaust gas thus purified in the catalytic converter 33 is discharged into the atmosphere.

The illustrated internal combustion engine is also equipped with a canister 37 containing activated charcoal (adsorbent) 36. The canister 37 has a fuel vapor chamber **38*a* and an air chamber 38*b* disposed opposite each other on either side of the activated charcoal 36. The fuel vapor chamber 38*a* communicates at one end with the fuel tank 15 through a vapor collector pipe 35, and at the other end with the surge tank 11, located in the intake passage downstream of the throttle valve 7, through a purge passage 39. Installed in the purge passage 39 is a solenoid valve 41 for controlling the purge gas amount. In this construction, fuel vapor emitted from the fuel tank 15 is introduced through the vapor collector pipe 35 into the canister 37 where the vapor is temporarily stored by being adsorbed onto the activated charcoal (adsorbent) 36 contained therein. When the solenoid valve 41 is opened, vacuum in the intake manifold causes air in the air chamber 38*b* to be drawn through the activated charcoal 36 into the purge passage 39. When the air passes through the activated charcoal 36, the fuel vapor adsorbed on the activated charcoal 36 is desorbed. In this way, the air is mixed with the fuel vapor, and the resulting vapor is introduced through the purge passage 39 into the surge tank 11 and mixed with the fuel injected through the fuel injector valve 21 for use as fuel in the cylinder 1. Not only the vapor temporarily stored on the activated charcoal is introduced into the purge passage 39, as described above, but vapor is also drawn into the purge passage 39 directly from the fuel tank 15**.

An engine electronic control unit (engine ECU) 60 is also shown and is a microcomputer system that performs control operations, such as fuel injection control described in detail later and ignition timing control for sending an ignition signal to the igniter after determining optimum ignition timing by comprehensively judging the engine condition based on engine rpm and on the signals from various sensors. The signals from the various sensors are input via an A/D conversion circuit 64 or via an input interface circuit 65 to a CPU 61 which, in accordance with programs stored in a ROM 62, performs operations using the input signals, and based on the results of the operations, outputs control signals for various actuators via an output interface circuit 66. A RAM 63 is used to temporarily store data during the operation and control processes. These constituent parts of the ECU are interconnected by a system bus 69 (which consists of an address bus, a data bus, and a control bus).

Figure 2:
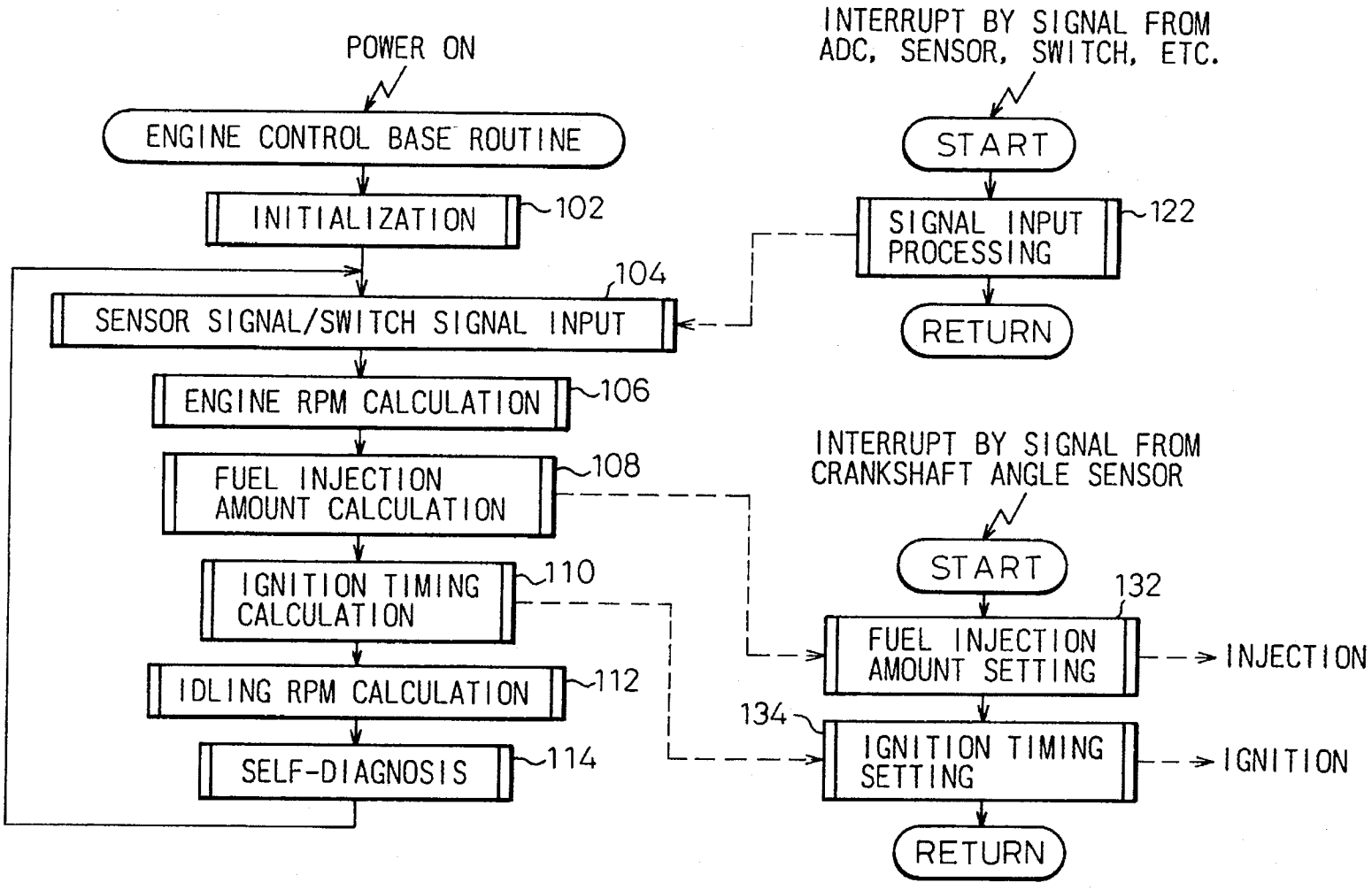
FIG. 2 is a simplified flowchart for explaining a basic procedure for engine control operations according to one embodiment of the present invention.

The engine ECU 60 operates by looping through instructions in accordance with a base routine, and during the execution of the base routine, services interrupts to carry out operations synchronized with input signal changes, engine revolutions, or time. More specifically, as shown in FIG. 2, when power is turned on, the engine ECU 60 performs a prescribed initialization (step 102), after which sensor signal/switch signal input (step 104), engine rpm calculation (step 106), fuel injection amount calculation (step 108), ignition timing calculation (step 110), idle rpm calculation (step 112), and self-diagnosis (step 114) are repeated in a loop. Signals output from the A/D conversion circuit (ADC) or some of the sensors or switches are handled as interrupts requesting servicing (step 122). Further, since the results of the fuel injection amount or ignition timing calculation must be supplied to the appropriate actuator with optimum timing synchronized with engine revolution, these are serviced as interrupts caused by signals from the crankshaft angle sensor (steps 132, 134). Other processing that needs to be carried out at predetermined intervals of time is carried out using a timer interrupt routine.

Basically, fuel injection control involves calculating the fuel injection amount, that is, the time the fuel injector valve 21 is open, from the intake air amount measured by the air flow meter 4 and the engine rpm obtained from the crankshaft angle sensor 47, and the thus calculated amount of fuel is injected when a prescribed crankshaft angle is reached. In the above calculation, corrections are made, such as basic corrections based on signals from the throttle angle sensor 9, the coolant temperature sensor 51, the intake air temperature sensor 3, etc., an air-fuel ratio feedback correction based on a signal from the $O_2$ sensor 31, an air-fuel ratio learning correction to bring the median of the feedback correction value to stoichiometry, and a correction based on canister purge. The present invention is concerned, in particular, with canister purge and fuel injection amount corrections based on canister purge. The following describes in detail a fuel injection amount calculation routine (which corresponds to step 108 in the base routine) and a purge control routine (which is initiated by a timer interrupt) which implement the fuel-vapor control according to the present invention.

Figure 3A:
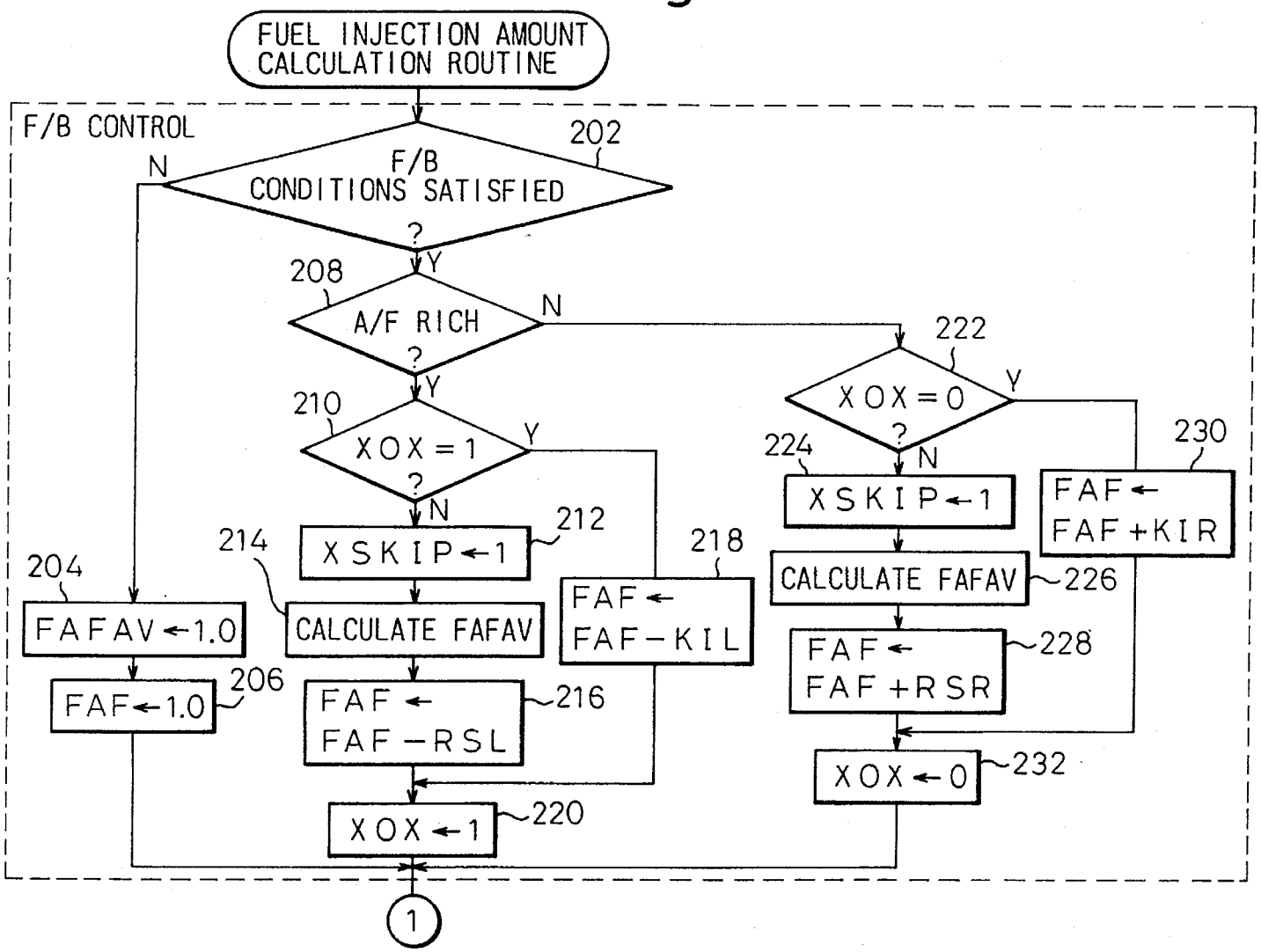
FIGS. 3A, 3B, 3C, and 3D show a simplified flowchart illustrating a procedure for fuel injection amount calculation according to one embodiment of the present invention.
Figure 3B:
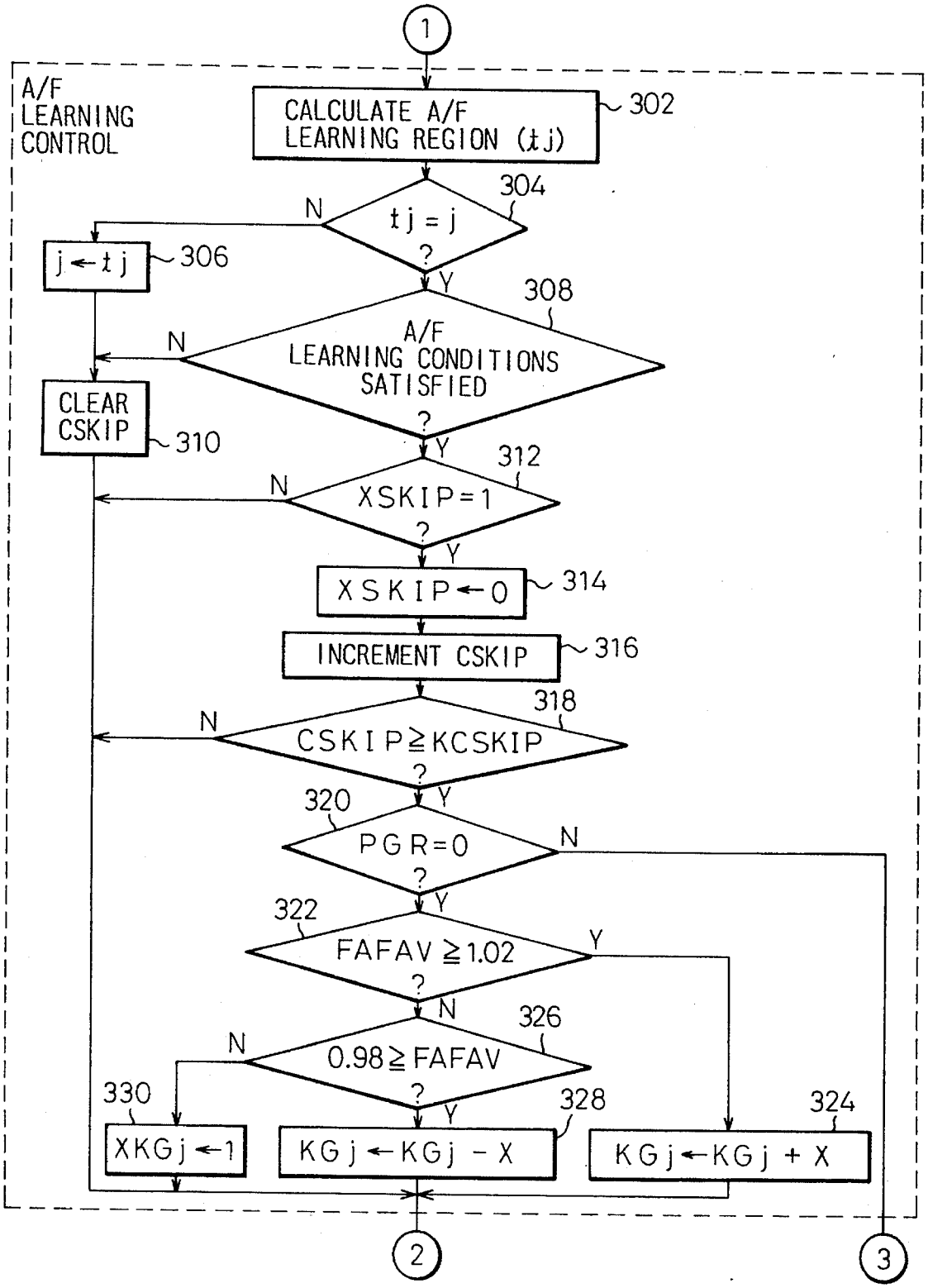
Figure 3C:
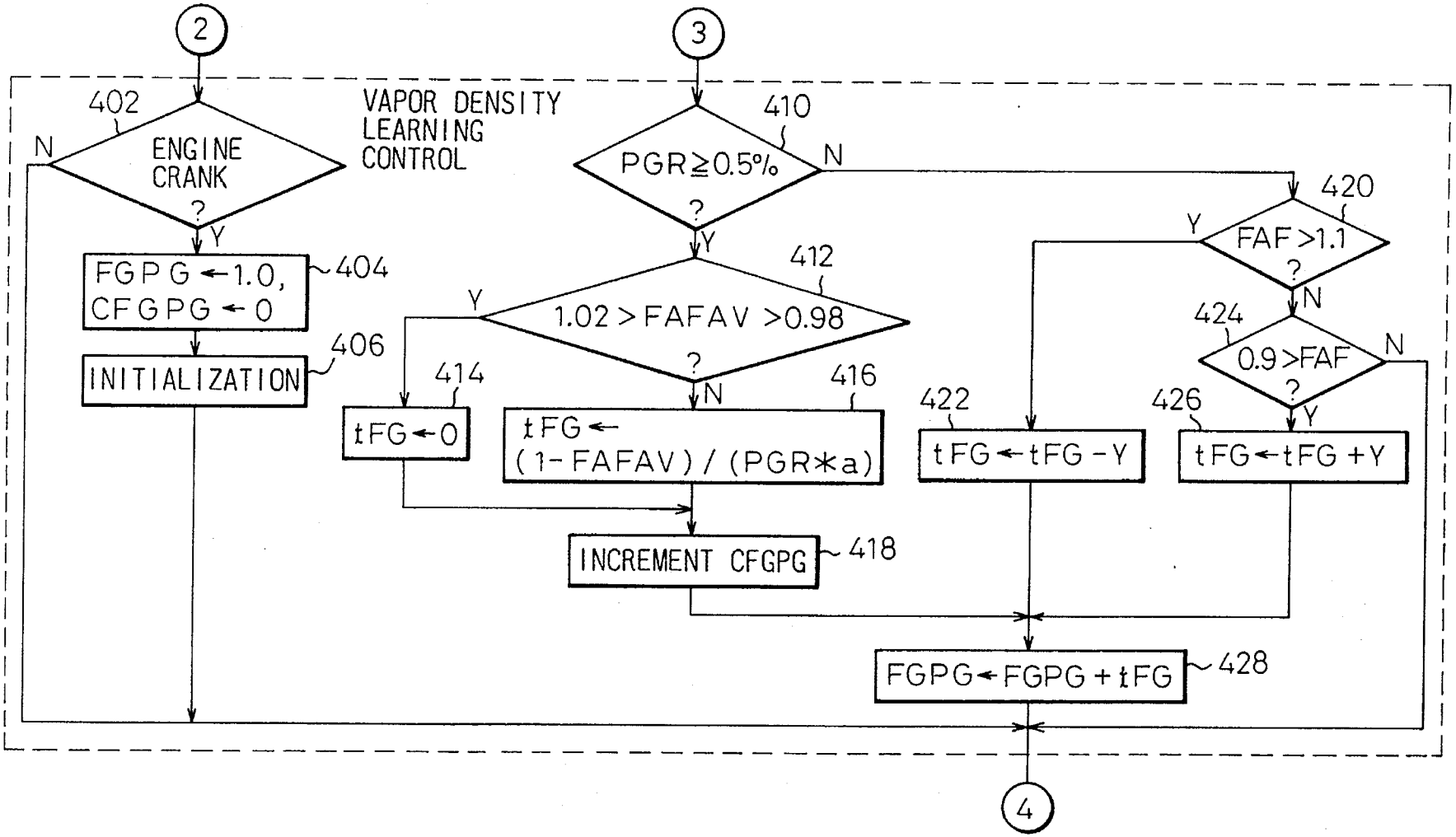
Figure 3D:
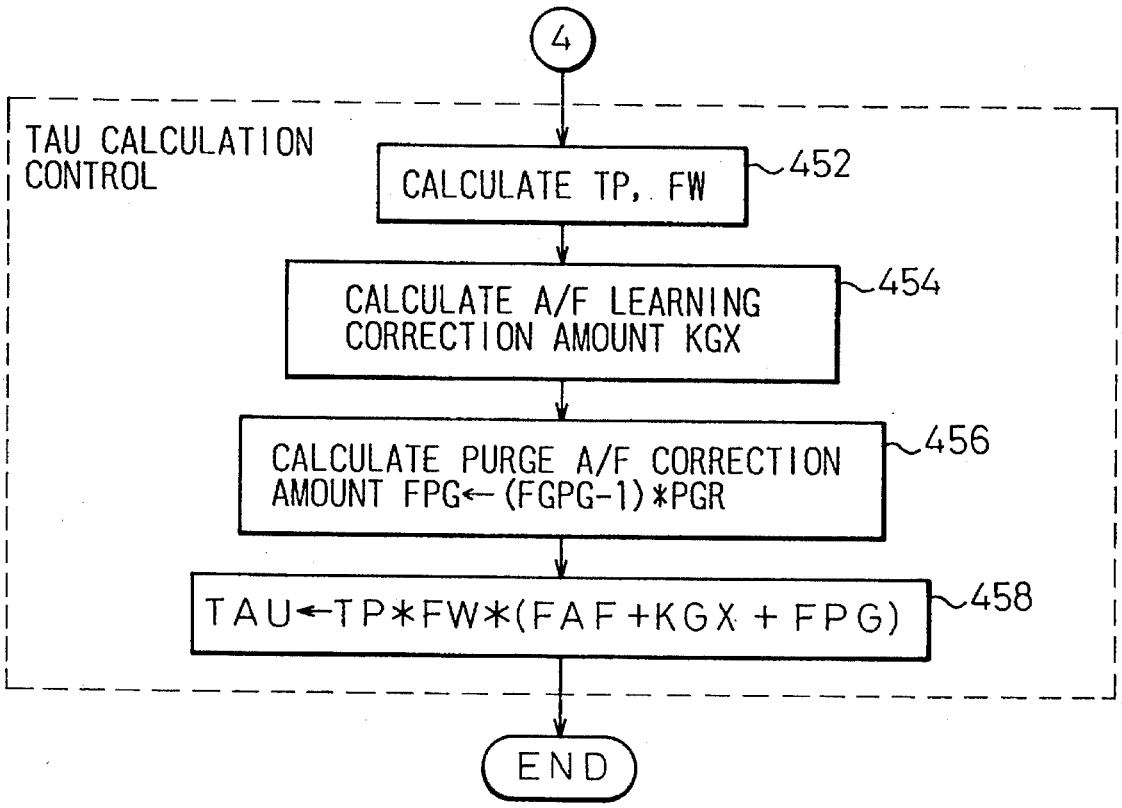

FIG. 3A to 3D show a simplified flowchart illustrating a procedure for fuel injection amount calculation according to one embodiment of the invention. The fuel injection amount calculation routine shown consists of air-fuel ratio (A/F) feedback (F/B) control (FIG. 3A), A/F learning control (FIG. 3B), vapor density learning control (FIG. 3C), and fuel injection time (TAU) calculation control (FIG. 3D). F/B control will be described to start with.

In F/B control, first a decision is made as to whether all of the following F/B conditions are satisfied (step 202).

(1) Not during engine crank.

(2) Not during fuel cutoff (F/C).

(3) Coolant temperature $\geqq 40°$ C.

(4) Activation of A/F sensor ($O_2$ sensor) completed.

If the answer to the decision is YES, then a decision is made as to whether the air-fuel mixture (A/F) is rich, that is, whether the output voltage of the $O_2$ sensor 31 is lower than a reference voltage (for example, 0.45 V) (step 208).

If the answer to the decision in step 208 is YES, that is, if A/F is rich, then a decision is made as to whether A/F was also rich in the previous cycle, by checking whether an air-fuel rich flag XOX is 1 or not (step 210). If the answer to the decision is NO, that is, if A/F was lean in the previous cycle and has changed to rich in the current cycle, a skip flag XSKIP is set to 1 (step 212), a mean FAFAV between the air-fuel ratio feedback correction coefficient FAF immediately before the previous skip and the FAF immediately before the current skip is calculated (step 214), and the air-fuel ratio feedback correction coefficient FAF is decreased by a predetermined skip amount RSL (step 216). On the other hand, if the answer to the decision in step 210 is YES, that is, if A/F was also rich in the previous cycle, the air-fuel ratio feedback correction coefficient FAF is decreased by a predetermined integrated amount KIL (step 218). After carrying out step 216 or 218, the air-fuel rich flag XOX is set to 1 (step 220), F/B control is terminated, and the process proceeds to the next A/F learning control (step 302).

On the other hand, if the answer to the decision in step 208 is NO, that is, if A/F is lean, then a decision is made as to whether A/F was also lean in the previous cycle, by checking whether the air-fuel rich flag XOX is 0 or not (step 222). If the answer to the decision is NO, that is, if A/F was rich in the previous cycle and has changed to lean in the current cycle, the skip flag XSKIP is set to 1 (step 224), a mean FAFAV between the air-fuel ratio feedback correction coefficient FAF immediately before the previous skip and the FAF immediately before the current skip is calculated (step 226), and the air-fuel ratio feedback correction coefficient FAF is increased by a predetermined skip amount RSR (step 228). On the other hand, if the answer to the decision in step 222 is YES, that is, if A/F was also lean in the previous cycle, the air-fuel ratio feedback correction coefficient FAF is increased by a predetermined integrated amount KIR (step 230). After carrying out step 228 or 230, the air-fuel rich flag XOX is set to 0 (step 232), F/B control is terminated, and the process proceeds to the next A/F learning control (step 302).

In the above process, if the answer to the decision in step 202 is NO, that is, if the F/B conditions are not satisfied, then FAFAV and FAF are each set to a reference value 1.0 (steps 204, 206), F/B control is terminated, and the process proceeds to the next A/F learning control (step 302).

Next, A/F learning control (FIG. 3B) will be described. First, computation is made based on the current intake manifold pressure to determine the current A/F learning region j (j=1 to 7) out of seven A/F learning regions 1 to 7 classified by intake manifold pressure, and the determined region is denoted by tj (j=1 to 7) (step 302). Here, the intake manifold pressure is detected by the vacuum sensor 12. Next, a decision is made as to whether the current learning region tj coincides with the previous learning region j (step 304). If they do not coincide, that is, if the learning region has changed, the current learning region tj is substituted for j (step 306), a skip count CSKIP is cleared (step 310), and A/F learning control is terminated, after which the process proceeds to vapor density learning control (step 402).

On the other hand, if the answer to the decision in step 304 is YES, that is, if the current learning region coincides with the previous learning region, then a decision is made as to whether all the following A/F learning conditions are satisfied (step 308).

(1) Air-fuel ratio F/B in progress.

(2) No increase after engine start and no increase for engine warmup.

(3) Coolant temperature ≧80° C.

If they are not satisfied, the skip count CSKIP is cleared (step 310), A/F learning control is terminated, and the process proceeds to vapor density learning control (step 402).

If the answer to the decision in step 308 is YES, that is, if the A/F learning conditions are satisfied, then a decision is made as to whether the skip flag XSKIP is 1, that is, whether there was a skip immediately before that (step 312). If the answer to the decision is NO, that is, if there was no skip immediately before that, then A/F learning control is terminated and the process proceeds to vapor density learning control (step 402). On the other hand, if the answer is YES, that is, if there was a skip immediately before that, the skip flag XSKIP is cleared to 0 (step 314) and the skip count CSKIP is incremented (step 316). Then, a decision is made as to whether the incremented skip count CSKIP has reached a predetermined value KCSKIP (for example, 3) (step 318). If the answer is NO, A/F learning control is terminated and the process proceeds to vapor density learning control (step 402).

On the other hand, if the answer to the decision in step 318 is YES, then a decision is made as to whether the purge ratio PGR calculated by the purge control routine described later is 0 or not (step 320). If the answer is NO, that is, if purge is currently being performed, A/F learning control is terminated and the process proceeds to vapor density learning control (step 410). On the other hand, if PGR is 0, that is, if purge is not being performed, a learning value KGj (j=1 to 7) for the current learning region j is changed, according to the result of the comparison between the deviation of the FAFAV set in step 204, 214, or 226 in F/B control and a predetermined value (for example, 2%). That is, if FAFAV is equal to or greater than 1.02 (YES in step 322), the learning value KGj is increased by a predetermined value x (step 324); if FAFAV is less than 0.98 (YES in step 326), the learning value KGj is decreased by the predetermined value x (step 328). In other cases, an A/F learning end flag XKGj for the current learning region j is set to 1 (step 330). After A/F learning control is thus terminated, the process proceeds to vapor density learning control (step 402).

Next, vapor density learning control (FIG. 3C) will be described. First, in step 402, a decision is made as to whether the engine is being cranked. If the engine is not being cranked, vapor density learning control is terminated and the process proceeds to TAU calculation control (step 452). If the engine is being cranked, the vapor density is set to the reference value 1.0, while clearing a vapor density update count CFGPG to 0 (step 404). Next, other initialization processing is carried out (step 406), to terminate vapor density learning control.

In A/F learning control, if the answer to the decision in step 320 is NO, that is, if the A/F learning conditions are satisfied, and if a purge operation is in progress, the process proceeds to step 410 in vapor density learning control, where a decision is made as to whether or not the purge ratio PGR is greater than or equal to a predetermined value (for example, 0.5%). If the answer to the decision is YES, then a decision is made as to whether or not FAFAV is within a predetermined value (±2%) with respect to the reference value 1.0 (step 412). If FAFAV is within such a range, a purge density update value tFG per purge ratio is set to 0 (step 414); if not within such a range, the vapor density update value tFG per purge ratio is calculated from the following equation (step 416).

$$tFG \leftarrow (1-FAFAV)/(PGR*a)$$

where a=constant (for example, 2) Next, the vapor density update counter CFGPG is incremented (step 418), and the process proceeds to step 428.

If the answer to the decision in step 410 is NO, that is, if the purge ratio PGR is smaller than 0.5%, this means that the vapor density update accuracy is not good; therefore, the deviation of the air-fuel ratio feedback correction coefficient FAF is examined (to determine, for example, whether or not the deviation is outside ±10% of the reference value 1.0). If FAF is larger than 1.1 (YES in step 420), the vapor density update value tFG is decreased by a predetermined value Y (step 422); if FAF is smaller than 0.9 (YES in step 424), the vapor density update value tFG is increased by the predetermined value Y (step 426). Finally, in step 428, the vapor density FGPG is corrected by the vapor density update value tFG obtained in the above process, after which vapor density learning control is terminated and the process proceeds to TAU calculation control (step 452).

Next, TAU (fuel injection time) calculation control (FIG. 3D) will be described. First, by referencing data stored as a map in the ROM 62, a basic fuel injection time TP is obtained based on engine rpm and engine load (intake air amount per engine revolution), and also, a basic correction coefficient FW is calculated based on signals from various sensors such as the throttle angle sensor 9, the coolant temperature sensor 51, and the intake air temperature sensor 3 (step 452). Here, the engine load may be estimated using the intake manifold pressure and engine rpm. Next, an A/F learning correction amount KGX appropriate to the current intake manifold pressure is calculated by interpolation from the A/F learning value KGj of an adjacent learning region (step 454).

Next, using the vapor density FGPG and the purge ratio PGR, a purge A/F correction amount FPG is calculated from the following equation (step 456).

$$FPG \leftarrow (FGPG-1)*PGR$$

Finally, the fuel injection time TAU is calculated from the following equation (step 458).

$$TAU \leftarrow TP*FW*(FAF+KGX+FPG)$$

This completes the fuel injection amount calculation routine.

Figure 4A:
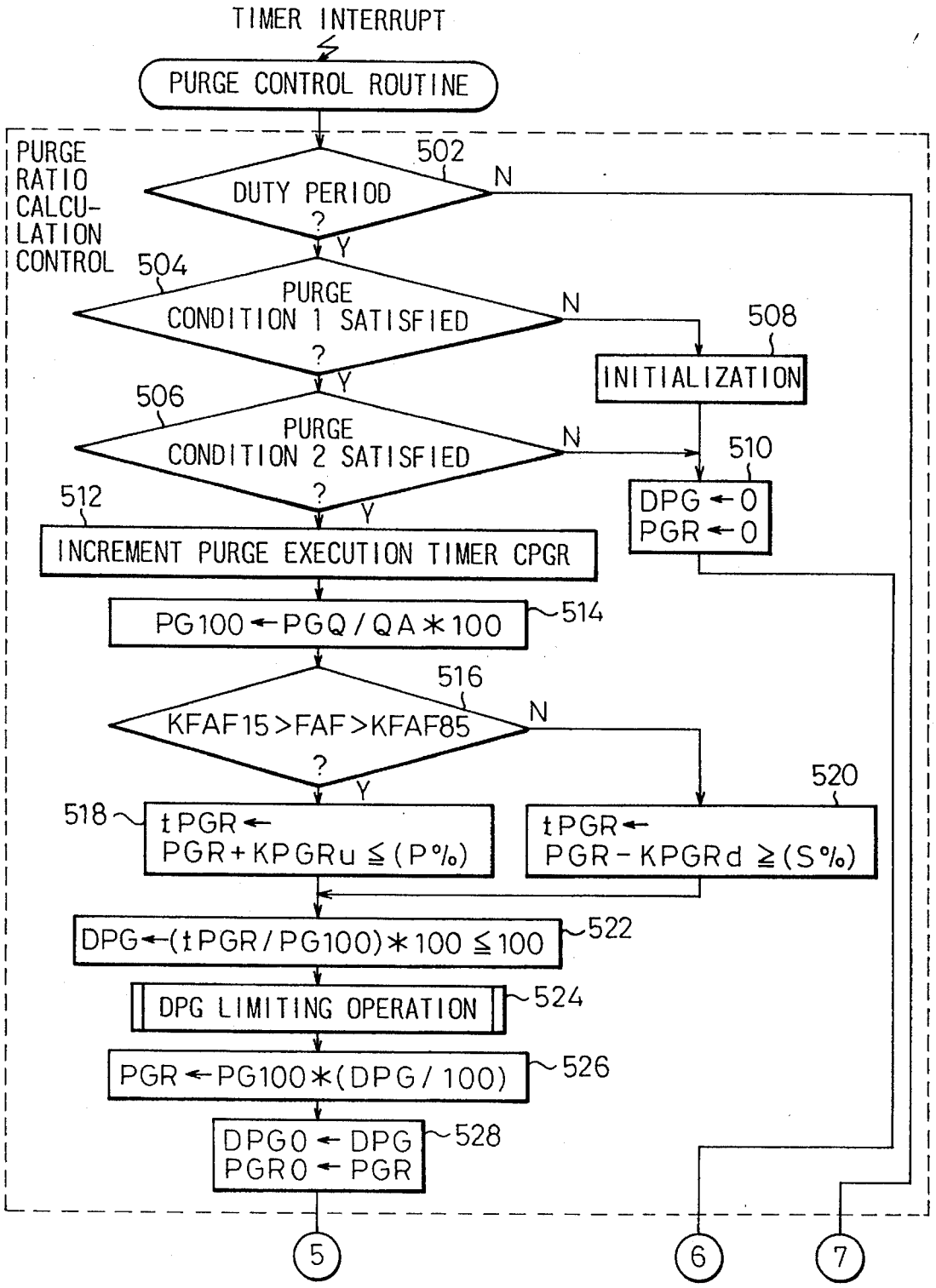
FIGS. 4A and 4B show a flowchart illustrating a procedure for purge control operations according to one embodiment of the present invention.
Figure 4B:
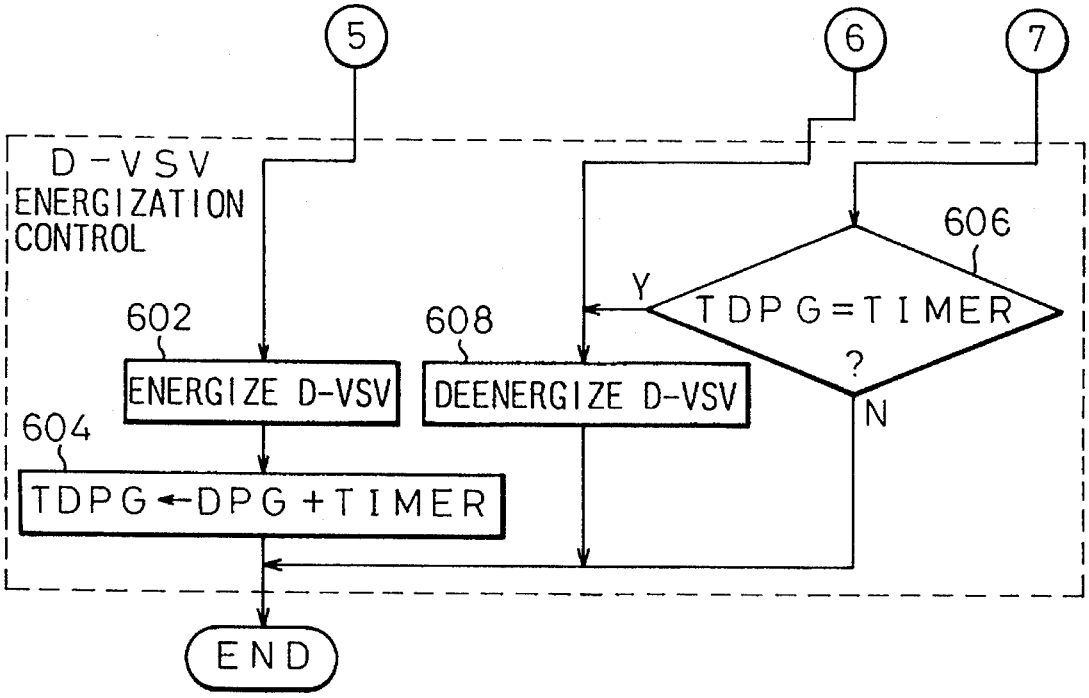

FIGS. 4A and 4B show a simplified flowchart illustrating a procedure for purge control operations according to one embodiment of the present invention. The purge control routine shown here is initiated by a timer interrupt that occurs at prescribed intervals of time (for example, 1 ms); in this routine, the duty cycle (the ratio of pulse ON time to pulse spacing) of a pulse signal used to control the operation of the D-VSV (purge gas amount control solenoid) 41 is determined, and using this pulse signal, the energization of the D-VSV is controlled. This routine consists of purge ratio (PGR) calculation control (FIG. 4A) and D-VSV energization control (FIG. 4B). First, purge ratio calculation control will be described.

In purge ratio calculation control (FIG. 4A), first a decision is made as to whether the execution of this routine coincides with a period in which the solenoid valve control pulse signal can be turned on, that is, whether it matches a prescribed duty period (for example, 100 ms) (step 502). If it matches the duty period, then a decision is made as to whether purge condition 1 is satisfied, that is, whether all the A/F learning conditions except the condition "Not during fuel cutoff" are satisfied (step 504). If purge condition 1 is satisfied, then a decision is made as to whether purge condition 2 is satisfied, that is, the fuel is not cut off and the A/F learning end flag XKGj is set to 1 (step 506).

Figure 5:
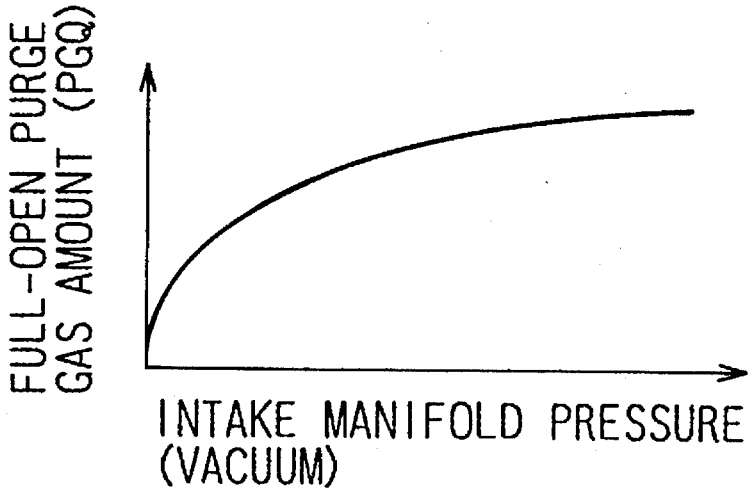
FIG. 5 is a characteristic diagram showing the relationship between the intake manifold pressure and the full-open purge gas amount.

If purge condition 2 also is satisfied, a purge execution timer CPGR is incremented (step 512). Then, by referencing the map shown in FIG. 5 (stored in the ROM 62) using the current intake manifold pressure as the key, a purge gas amount PGQ at full-open VSV is obtained, and a ratio between the purge gas amount PGQ and the intake air amount QA is calculated to determine the purge ratio PG100 at full-open VSV (step 514). Next, a decision is made as to whether or not the air-fuel ratio feedback correction coefficient FAF is inside predetermined limits (greater than a constant KFAF85 but smaller than a constant KFAF15) (step 516).

Figure 6:
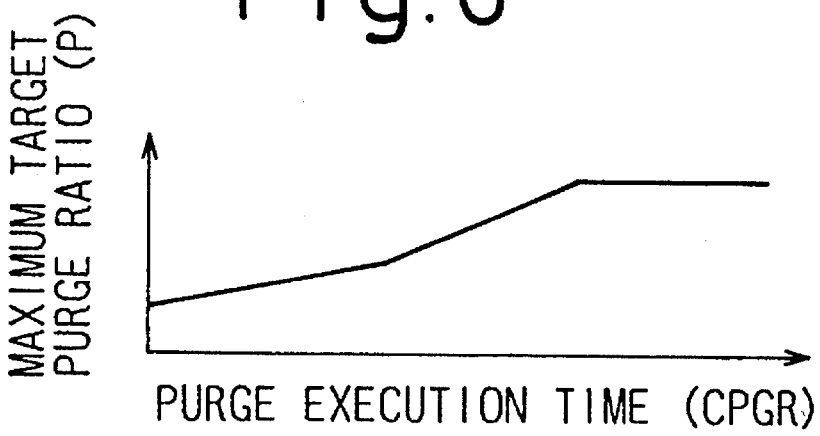
FIG. 6 is a characteristic diagram showing the relationship between the purge execution time and the maximum target purge ratio.

If the answer to the decision in step 516 is YES, a target purge ratio tPGR is increased by a predetermined amount KPGRu, while controlling the obtained tPGR within the maximum target purge ratio P% (obtained from the map shown in FIG. 6) determined based on the purge execution time CPGR (step 518). On the other hand, if the answer to the decision in step 516 is NO, the target purge ratio tPGR is lowered by a predetermined value KPGRd, while controlling the obtained tPGR, in a similar manner to that in step 518, so that it does not become smaller than a minimum target purge ratio s% (step 520). In this way, A/F perturbations associated with purge operations are prevented.

Next, based on the target purge ratio tPGR and the purge ratio PG100 at full-open VSV, the duty cycle DPG is calculated from the following equation (step 522).

$$DPG \leftarrow (tPGR/PG100)*100$$

Then, a duty cycle limiting operation, which constitutes a feature of the present invention, is performed on the thus obtained duty cycle DPG (step 524). The first to fifth embodiments of this DPG limiting operation will be described in detail later.

Next, taking into account a case where DPG is updated as a result of the DPG limiting operation in step 524, the actual purge ratio PGR is calculated from the following equation (step 526).

$$PGR \leftarrow PG100*(DPG/100)$$

Finally, based on the duty cycle DPG and purge ratio PGR obtained in the above process, DPGO and PGRO for "remembering" the previous duty cycle and purge ratio are updated (step 528), and the process proceeds to step 602 in D-VSV energization control.

On the other hand, if, in step 502, a decision is made that the execution of the routine does not match the duty period, the process proceeds to step 606 in D-VSV energization control. Further, if the execution does match the duty period, but if purge condition 1 is not satisfied in step 504, the corresponding RAM is initialized (step 508), duty cycle DPG and purge ratio PGR are both cleared to 0 (step 510), and the process proceeds to step 608 in D-VSV energization control. Also, if purge condition 2 is not satisfied in step 506, the duty cycle DPG and purge ratio PGR are both cleared to 0 (step 510), and the process proceeds to step 608 in D-VSV energization control.

Next, D-VSV energization control (FIG. 4B) will be described. First, in step 602, which is performed following step 528 in purge ratio control, VSV is energized. Next, in step 604, VSV deenergization time TDPG is obtained from the following equation, and the process is terminated.

$$TDPG \leftarrow DPG+TIMER$$

where TIMER is the value of a counter which is incremented for every execution cycle of the purge control routine.

In step 606, which is performed when the answer to the decision in step 502 is NO, a decision is made as to whether the current TIMER value coincides with the VSV deenergization time TDPG. If it does not coincide, the process is terminated; if it coincides, the process proceeds to step 608. In step 608, which is performed following step 510 or step 606, VSV is deenergized, and the process is terminated. The purge control routine is thus completed.

The duty cycle limiting operation (step 524) in the purge control routine (FIG. 4A) will now be described in detail below. As earlier described, the present invention is intended to suppress the phenomenon that when the density of the vapor emitted into the purge passage directly from the fuel tank is higher than that of the vapor from the canister, in other words, when the tank vapor has a greater contribution to the resulting vapor density, if the amount of purge gas is varied, the vapor density is caused to vary, hence causing large perturbations in the A/F. In the five embodiments hereinafter given, the criteria used in making a decision that the tank vapor has the greater contribution are described and, when such a decision is made, how the purge gas amount, that is, the duty cycle of the pulse signal to the solenoid valve, is actually limited is described.

First, a description is given of the first embodiment. In the first embodiment, the decision about whether the tank vapor amount is large or not is made based on the purge execution time, and an upper limit or a lower limit, or both, are imposed on the duty cycle. That is, as shown in FIG. 7B, the canister vapor adsorption amount decreases as the purge execution time increases, and the canister, if fully loaded first, will be emptied in about 20 to 30 minutes. Then, as shown in FIG. 7A, after a predetermined purge execution time has elapsed, the duty cycle DPG is limited using a maximum guard value MAXDPG and/or a minimum guard value MINDPG.

Figure 7A:
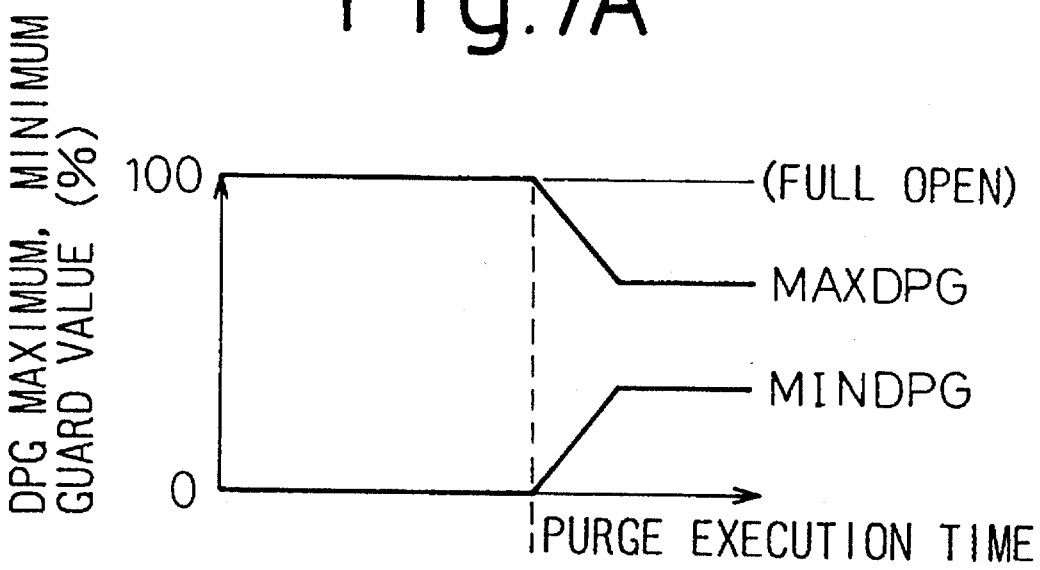
FIG. 7A is a characteristic diagram showing the relationship between the purge execution time and the maximum/minimum guard value of duty cycle DPG.
Figure 7B:
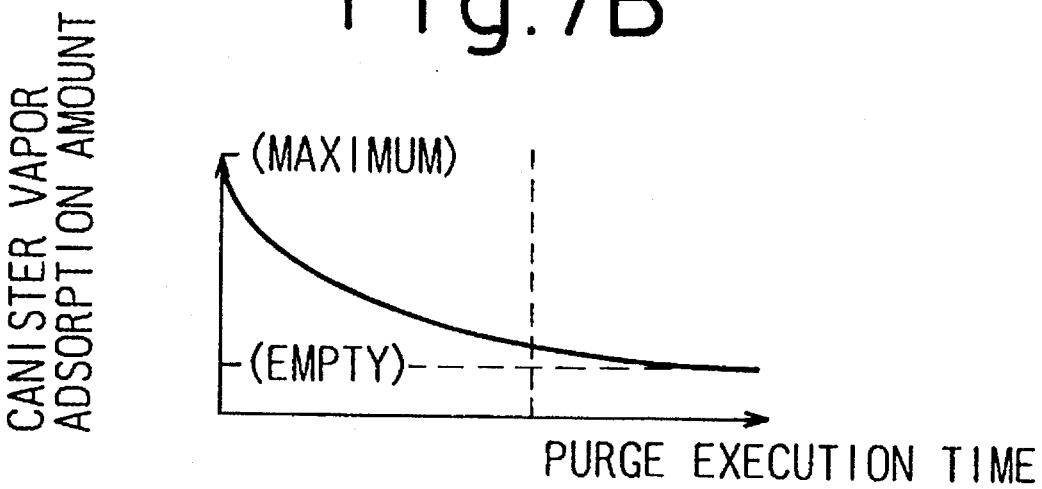
FIG. 7B is a characteristic diagram showing the relationship between the purge execution time and the canister vapor adsorption amount.
Figure 8:
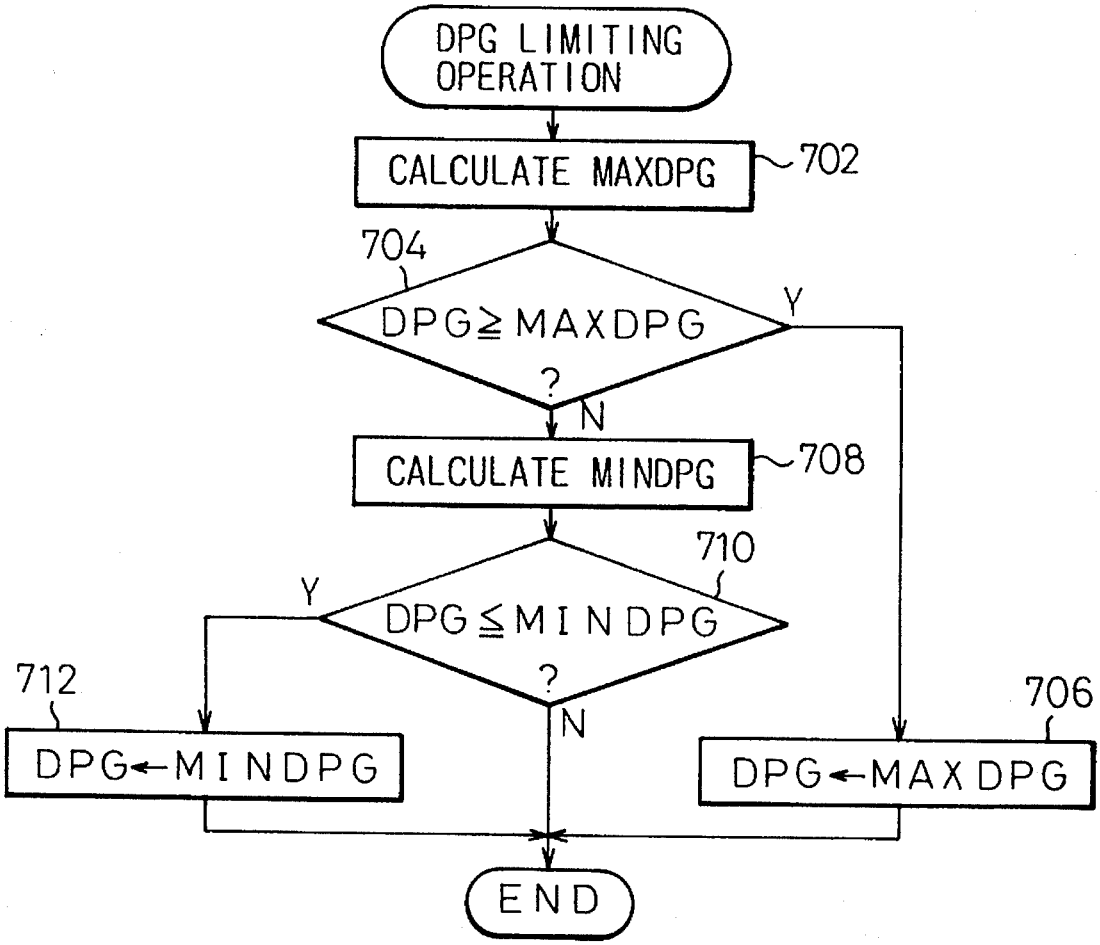
FIG. 8 is a flowchart illustrating a procedure for a duty cycle limiting operation according to a first embodiment of the present invention.

More specifically, a map such as the one shown in FIG. 7A is stored in advance in the ROM 62, and the DPG limiting operation shown in FIG. 8 is carried out. In the flowchart shown here, both the upper and lower limits are imposed, but one or other of the upper or lower limit may be used. First, by referencing the map using the current purge execution time as the key, the maximum guard value MAXDPG is obtained (step 702). Next, a decision is made as to whether or not the duty cycle DPG calculated in step 522 (FIG. 4A) is greater than or equal to MAXDPG (step 704). If the answer to the decision is YES, MAXDPG is substituted for DPG (step 706). On the other hand, if the answer is NO, the minimum guard value MINDPG is obtained in a similar way (step 708), and a decision is made as to whether or not the duty cycle DPG is smaller than or equal to MINDPG (step 710). If the answer to the decision is YES, MINDPG is substituted for DPG (step 712). If the answer to the decision is NO in both steps 704 and 710, the canister purge is allowed to be performed without imposing any limits.

As the purge execution time passes, the canister purge progresses and the contribution from the tank vapor increases. However, in this limiting operation, as the purge execution time increases, the upper limit of the duty cycle is lowered to suppress the increase in the amount of purge gas from the canister. This suppresses the change in vapor density that may occur during a transition from idling to driving (in the increasing direction of the purge gas amount), and improves the precision of A/F correction, the result being to suppress A/F perturbations. Furthermore, as the purge execution time increases, the lower limit of the duty cycle is raised to suppress the decrease in the amount of purge gas from the canister. This suppresses the change in vapor density that may occur during a transition from driving to idling (in the decreasing direction of the purge gas amount), and improves the precision of A/F correction, the resulting effect being to suppress A/F perturbations. By controlling both the upper and lower limits, A/F perturbations can be further suppressed. In any case, since priority is given to canister purge during early stages of the purge, there occurs no decrease in the adsorption ability of the canister.

Figure 9:
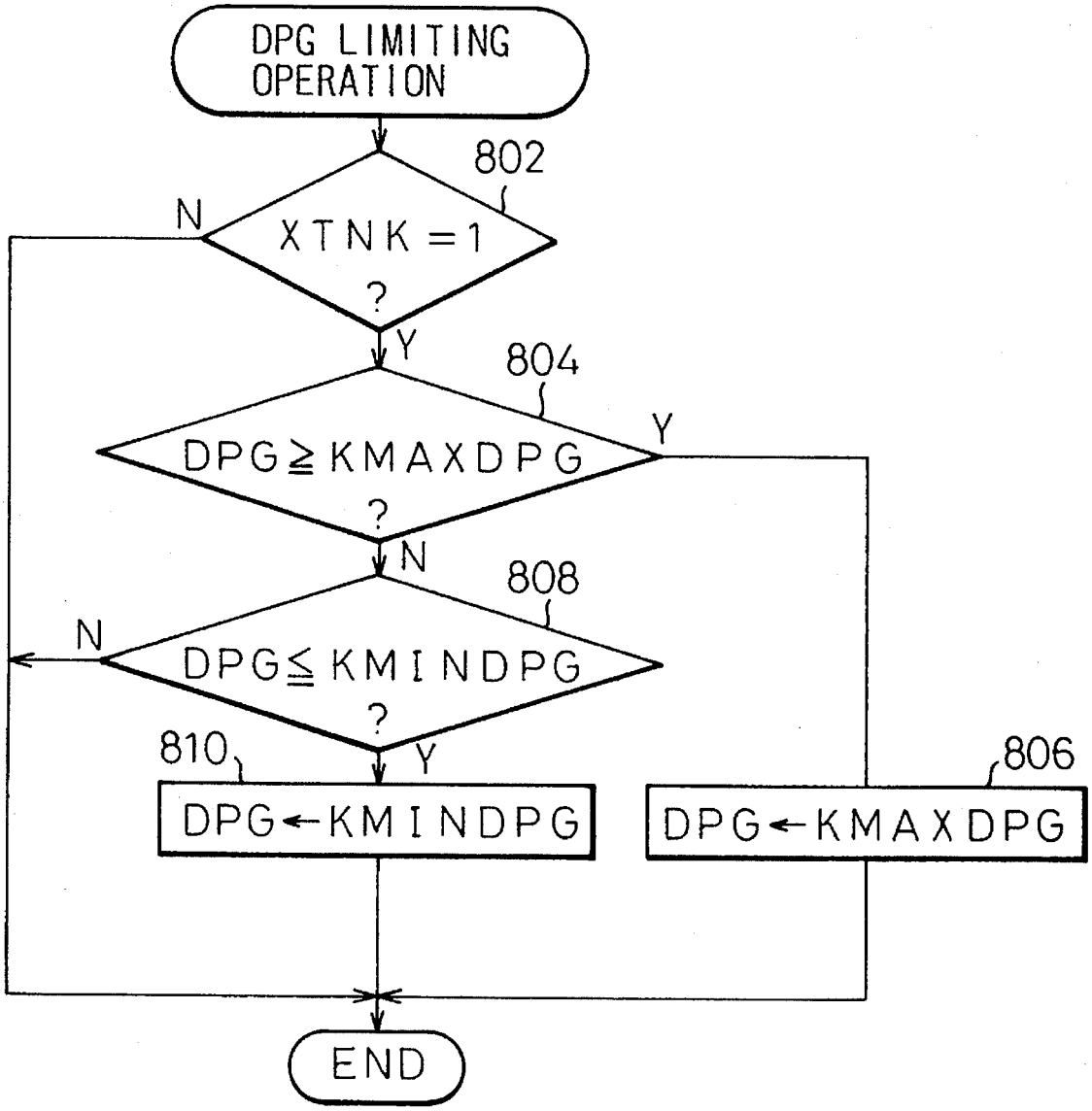
FIG. 9 is a flowchart illustrating a procedure for a duty cycle limiting operation according to a second embodiment of the present invention.

Next, the second embodiment will be described. In the second embodiment, sensors are provided that directly detect whether or not the amount of vapor from the fuel tank is large, and as in the first embodiment, the upper limit or lower limit of the duty cycle, or both, are controlled. An increase in the amount of vapor from the fuel tank occurs, for example, when the tank fuel temperature is high, or when the tank internal pressure is high. Therefore, sensors are provided that directly detect these variables, and output signals from these sensors are input, for example, in step 104 in the base routine shown in FIG. 2; then, when it is decided that the tank vapor amount is large, a flag XTNK indicating that occurrence is set. Then, based on the flag XTNK, the duty cycle (DPG) limiting operation shown in FIG. 9 is carried out. First, a decision is made as to whether XTNK is 1 or not (step 802), and if the answer to the decision is YES, DPG is limited using a prescribed maximum guard value KMAXDPG and minimum guard value KMINDPG (steps 804 to 810).

In the second embodiment, since an increase in the tank vapor is directly detected, as described above, control precision is improved, and unlike the first embodiment, a situation does not occur where a prescribed time has to pass if the engine is started when the canister vapor adsorption amount is small.

Next, the third embodiment will be described. In the third embodiment, a decision is made, based on the change of vapor density, as to whether the tank vapor amount is large, and based on the result of the decision, the upper limit or lower limit of the duty cycle, or both, are controlled. Further, the maximum guard value and the minimum guard value are controlled in multiple steps according to the mode of the vapor density change, thereby aiming at accomplishing the promotion of purging and the suppression of A/F perturbations at the same time.

Figure 10:
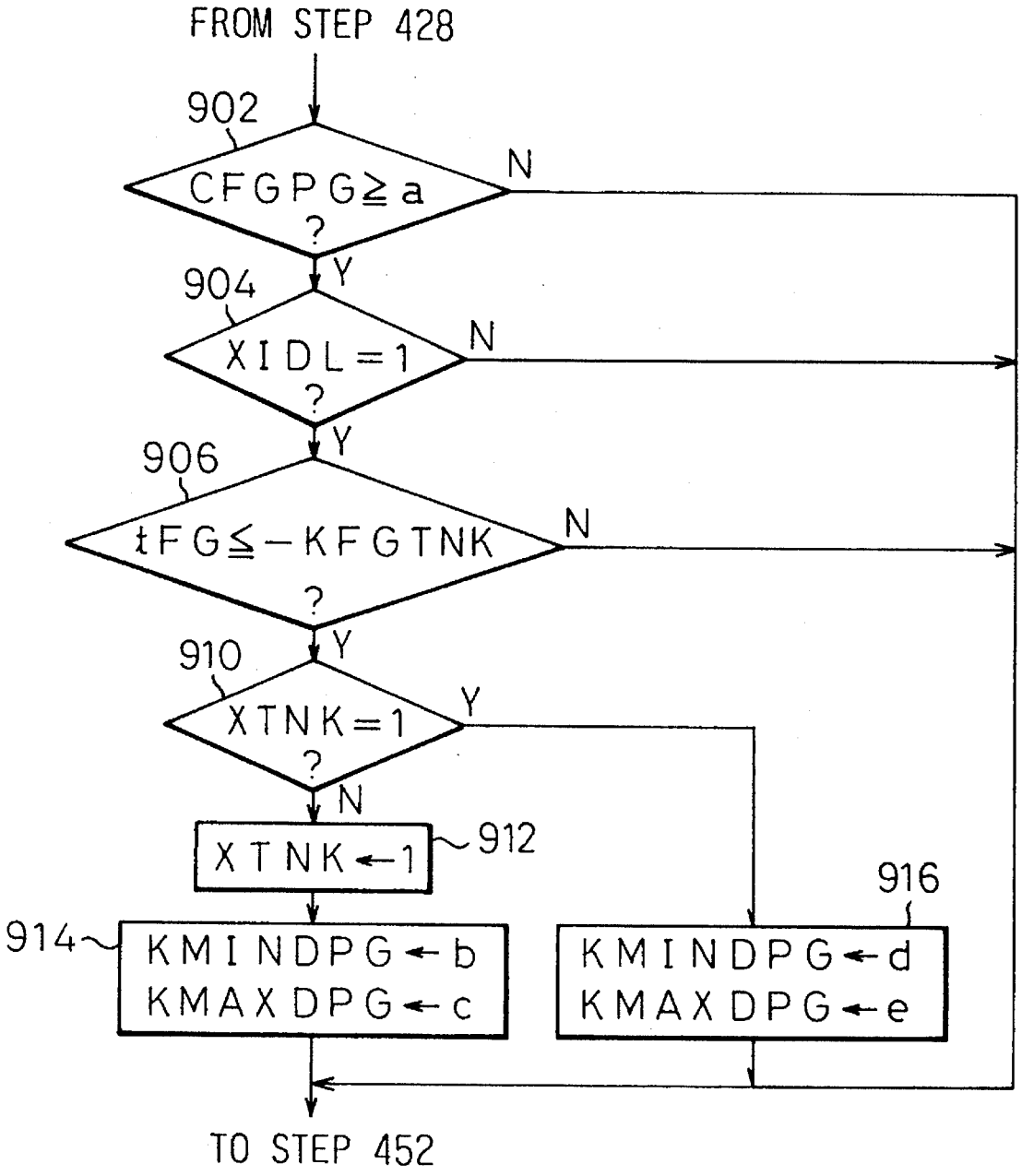
FIG. 10 is a flowchart illustrating a procedure for a vapor density change detection operation according to a third embodiment of the present invention.

More specifically, the vapor density change detection process shown in FIG. 10 is added to the end (after step 428) of the vapor density learning control (FIG. 3C). In this process, first a decision is made as to whether a vapor update count CFGPG has reached a prescribed count a (step 902). The prescribed count a represents the number of times (for example, 10) required to complete the vapor density learning in the early period of the purge. Alternatively, the decision may be made based on the purge execution time. If the answer to the decision in step 902 is YES, then a decision is made as to whether the engine is idling, that is, whether a flag XIDL indicating an idling condition is set to 1 (step 904). If the engine is idling, a decision is made as to whether or not the vapor density update value tFG is less than or equal to a predetermined value -KFGTNK (for example, −3%), that is, whether the vapor density update value tFG has been increased toward the rich side. If the answer to the decision is YES, then a decision is made as to whether the tank vapor large flag XTNK is 1, that is, whether the flag is already set (step 910). If the answer to the decision in step 910 is NO, that is, if it is decided for the first time that the tank vapor amount is large, then the flag is set to 1 (step 912), and a predetermined value b is substituted for the minimum guard value KMINDPG and a predetermined value c for the maximum guard value KMAXDPG (step 914). On the other hand, if the answer to the decision in step 910 is YES, that is, if it is decided that the tank vapor amount is already large, d is substituted for the minimum guard value KMINDPG and e for the maximum guard value KMAXDPG, where d and e are predetermined values such that d>b and e<c (step 916). This means that, except when the tank vapor amount is judged as being large for the first time, severe limits are imposed, that is, the upper and lower limits are set in multiple steps. The flag XTNK is reset in the initialization operation (step 102 in FIG. 2), and after it has been set as described above, there is no need to reset it.

The DPG limiting operation is performed using the thus set flag XTNK, maximum guard value KMAXDPG, and minimum guard value KMINDPG. The operating procedure is the same as that of the second embodiment illustrated in the flowchart of FIG. 9, and therefore, will not be repeated here.

In the third embodiment, since the decision on whether the tank vapor amount is large or not is made based on the detection of a change in the vapor density, as described above, sensors such as a tank pressure detection sensor, as required in the second embodiment, need not be provided. Furthermore, since the upper and lower limits of the duty cycle DPG are set in multiple steps each time the amount of generated vapor, and hence the vapor density, changes beyond a predetermined limit, A/F perturbations caused by the canister purge and the tank vapor can be prevented in an appropriate manner.

Figure 11:
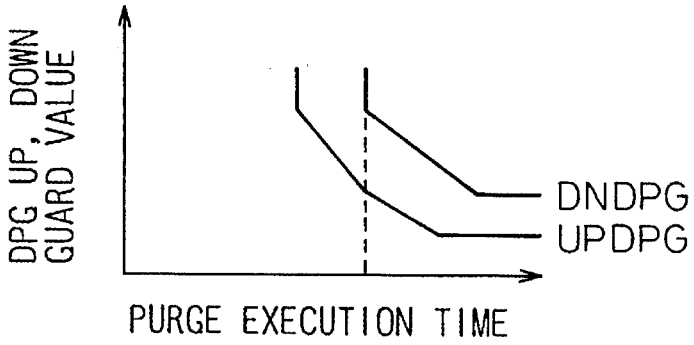
FIG. 11 is a characteristic diagram showing the relationship between the purge execution time and the up guard/down guard value of duty cycle DPG.
Figure 12:
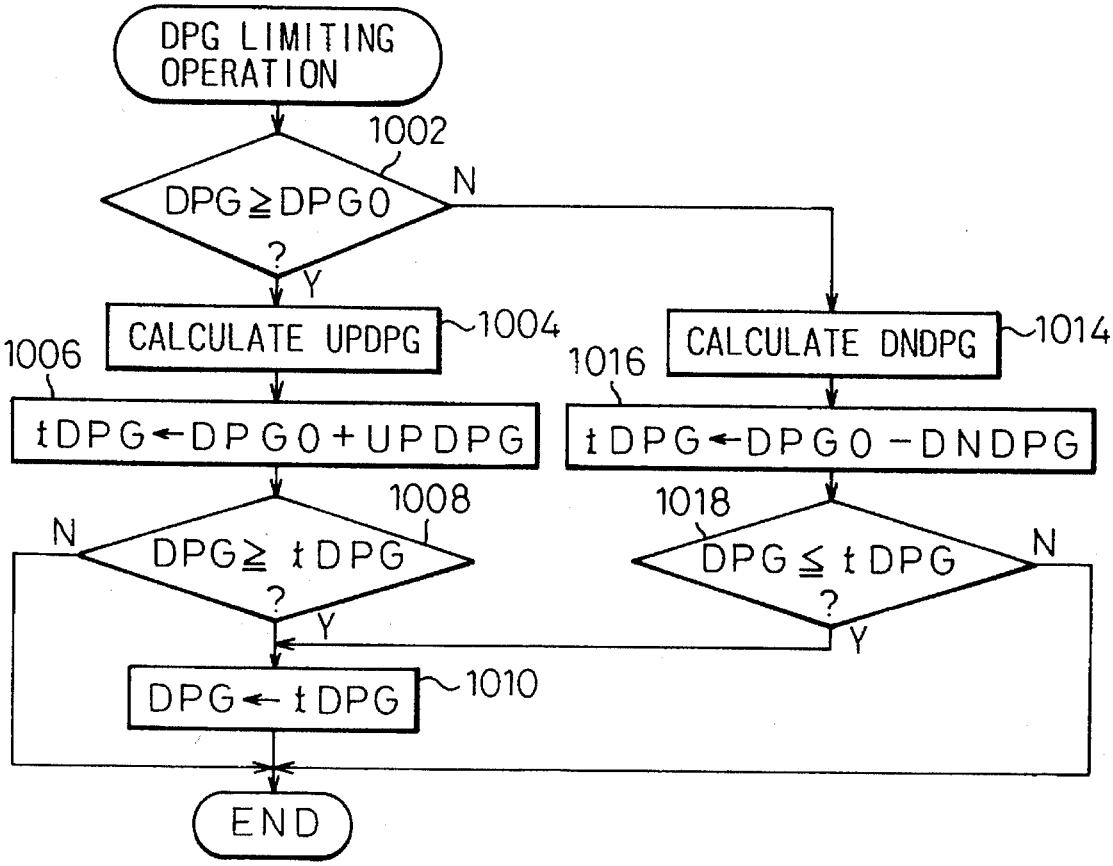
FIG. 12 is a flowchart illustrating a procedure for a duty cycle limiting operation according to a fourth embodiment of the present invention.

Next, the fourth embodiment will be described. In the fourth embodiment, as in the first embodiment, the decision on whether the tank vapor amount is large or not is made based on the purge execution time, but unlike the first embodiment, the fourth embodiment is intended to limit the amount of increase or the amount of decrease, or both, of the duty cycle DPG with respect to the previous duty cycle DPGO (calculated in step 528 in FIG. 4A). More specifically, a map defining a DPG up guard value UPDPG and/or a DPG down guard value DNDPG, both decreasing with increasing purge execution time, such as the one shown in FIG. 11, is provided, and using this map, the DPG limiting operation shown in FIG. 12 is carried out.

First, a decision is made as to whether the DPG calculated in the current process is on the upper side or lower side of the previously calculated DPGO (step 1002). If it is on the upper side of the previous value, the DPG up guard value UPDPG is obtained by referencing the map of FIG. 11 using the current purge execution time as the key (step 1004). Next, the thus obtained UPDPG is added to the DPGO calculated in step 528, and the result is taken as DPG guard value tDPG (step 1006). Then, the current DPG is compared with tDPG (step 1008), and if the current DPG is larger than or equal to tDPG, DPG is replaced by tDPG (step 1010). On the other hand, if it is decided in step 1002 that the current DPG is smaller than the previous value, the DPG down guard value DNDPG is obtained by referencing the map of FIG. 11 using the current purge execution time as the key (step 1014). Next, DNDPG is subtracted from the DPGO calculated in step 528, and the result is taken as the DPG guard value tDPG (step 1016). Then, the current DPG is compared with tDPG (step 1018), and if the current DPG is smaller than or equal to tDPG, DPG is replaced by tDPG (step 1010).

In this manner, as the purge execution time increases, the allowable amount of increase of the duty cycle DPG is reduced, thereby reducing the rate at which the purge gas amount can increase from the previous value. This has the effect of stabilizing the vapor density during a transition from idling to driving (in the increasing direction of the purge gas amount). Further, as the purge execution time increases, the allowable amount of decrease of the duty cycle DPG is reduced, thereby reducing the rate at which the purge gas amount can decrease from the previous value. This has the effect of stabilizing the vapor density during a transition from driving to idling (in the decreasing direction of the purge gas amount). In either case, the effect can be further enhanced by combining the above control with the upper or lower limit control means described in the first embodiment.

Next, the fifth embodiment will be described. In the fifth embodiment, as in the third embodiment, the decision on whether the tank vapor amount is large or not is made based on the change of the vapor density, and like the fourth embodiment, the fifth embodiment is also intended to control the amount of increase or the amount of decrease, or both, of the duty cycle DPG with respect to the previous duty cycle DPGO. In the fifth embodiment, however, the DPG up guard value and the DPG down guard value are each controlled in multiple steps according to the mode of the vapor density change.

Figure 13:
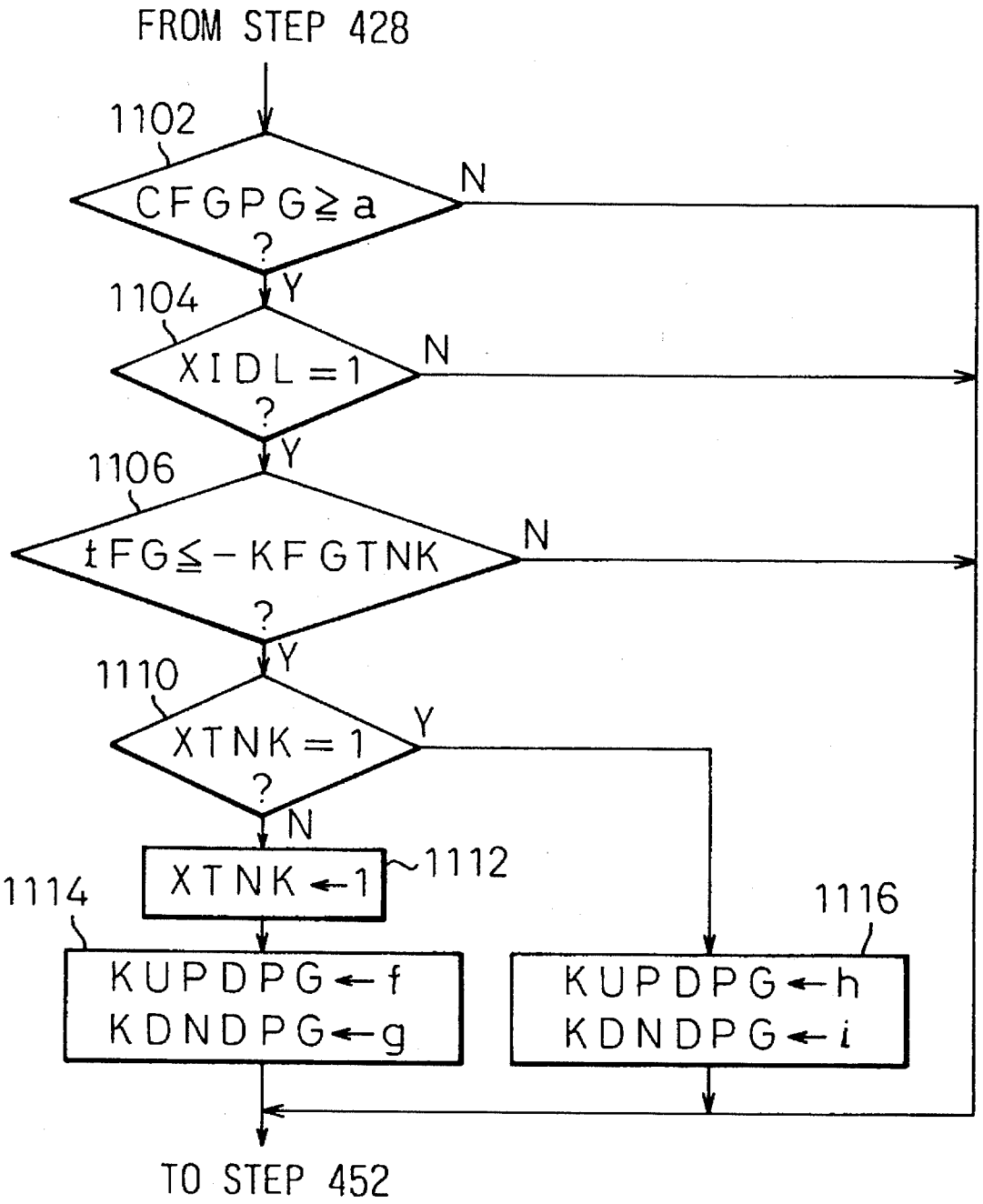
FIG. 13 is a flowchart illustrating a procedure for a vapor density change detection operation according to a fifth embodiment of the present invention.

More specifically, as in the third embodiment, the vapor density change detection process shown in FIG. 13 is added to the end (after step 428) of the vapor density learning control (FIG. 3C). In the process shown in FIG. 13, steps 1114 and 1116 are different from the corresponding steps shown in FIG. 10, with KMAXDPG and KMINDPG in FIG. 10 replaced by an up guard value KUPDPG and a down guard value KDNDPG, respectively. Otherwise, the process is identical to that shown in FIG. 10, and therefore, detailed description of the process will not be given here. It will be noted, however, that, like the third embodiment, constants f, g, h, and i are so set as to reduce the amount of change, i.e. the amount of increase or the amount of decrease, to a greater extent when a change in the vapor density is detected successively than when the change is detected for the first time.

Figure 14:
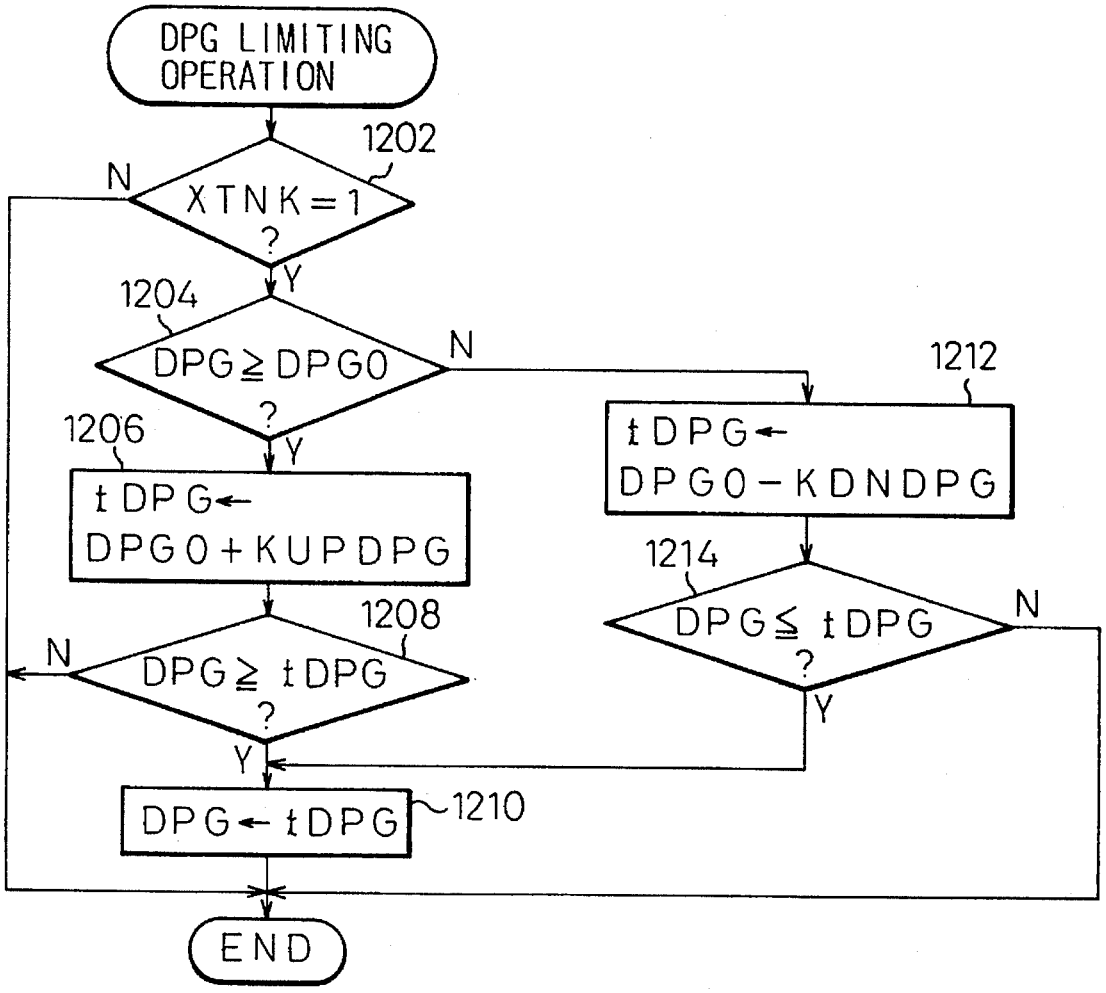
FIG. 14 is a flowchart illustrating a procedure for a duty cycle limiting operation according to the fifth embodiment of the present invention.

The procedure for the DPG limiting operation according to the fifth embodiment is illustrated in the flowchart of FIG. 14. First, a decision is made as to whether XTNK is 1 or not (step 1202); if the answer to the decision is YES, the amount of increase and the amount of decrease are limited (step 1204 to 1210), using the up guard value KUPDPG and down guard value KDNDPG obtained in the process of. FIG. 13. The procedure for such a change amount limiting operation is similar to the procedure of the fourth embodiment illustrated in FIG. 12, and therefore, no further explanation is necessary.

As described, in the fifth embodiment, the decision on whether the tank vapor amount is large or not is made by detecting the change of the vapor density, and based on the result of the decision, the allowable amount of increase or decrease of the duty cycle DPG is reduced, thereby reducing the rate at which the purge gas amount can increase or decrease from the previous value. This has the effect of stabilizing the vapor density and suppressing A/F perturbations.

Figure 15:
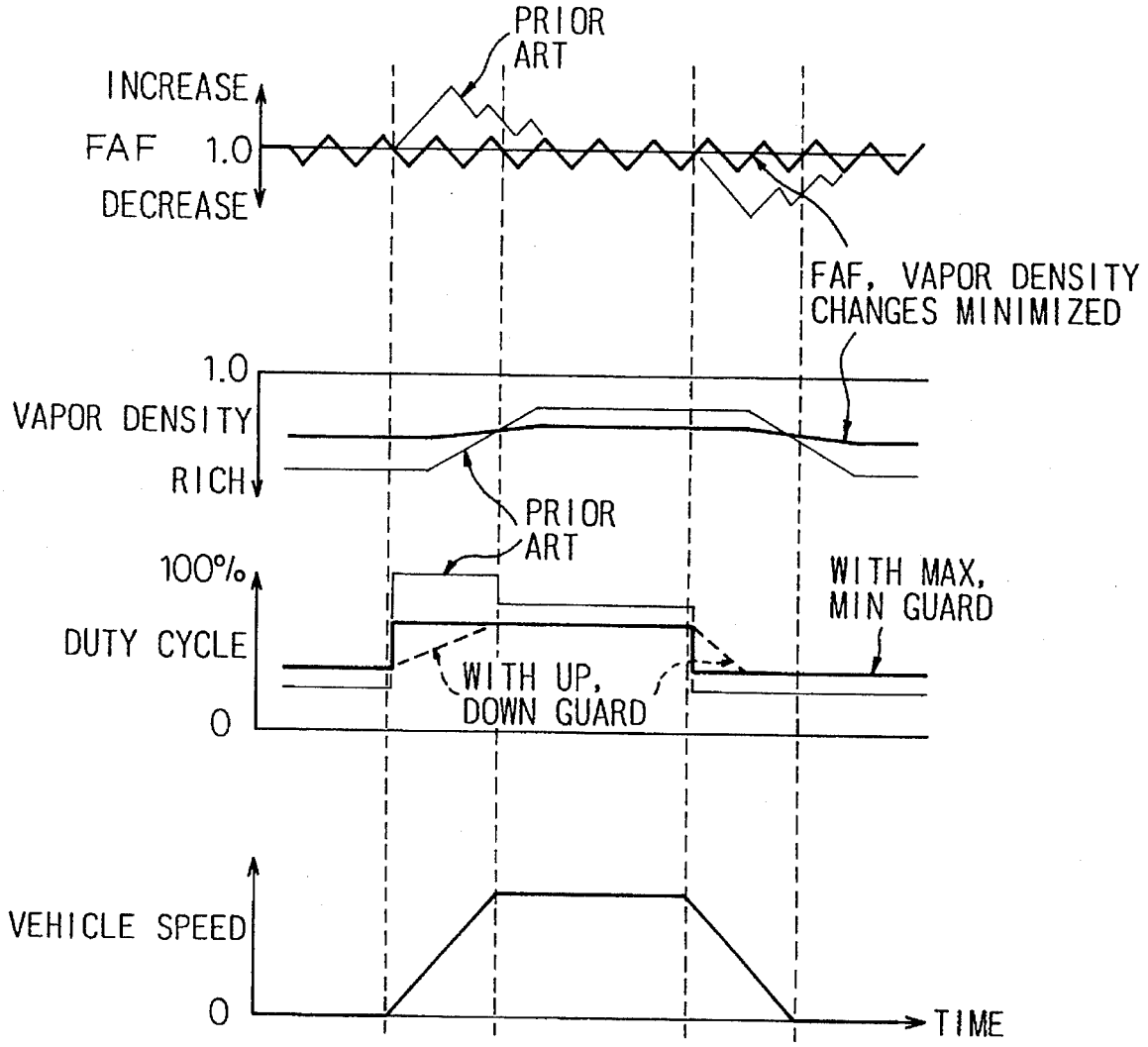
FIG. 15 is a diagram showing control according to the present invention by comparison with control according to the prior art.

FIG. 15 shows the control according to the present invention in comparison with the prior art control. In the case of the prior art purge-ratio-constant control, during idling when the intake air amount (hence, the fuel injection amount) is small, the tank vapor contribution (the ratio of the tank vapor amount to the fuel injection amount) is large and the degree of richness is overestimated and during driving when the intake air amount is large, the tank vapor contribution is small and the degree of richness is under-estimated. Accordingly, immediately after an idle-to-driving transition, since the A/F correction is made based on the vapor density during idling, the fuel increase correction is insufficient, resulting in acceleration enleanment. Conversely, immediately after a driving-to-idling transition, since the A/F correction is made based on the vapor density during driving, fuel decrease correction is insufficient, resulting in deceleration enrichment. This impairs drivability, etc.

On the other hand, in the case of the control according to the present invention, during a transition from idling to driving (in the increasing direction of the purge gas amount), the upper limit of the purge gas amount is lowered to suppress the change in the vapor density. This improves the precision of the A/F correction and hence contributes to suppressing A/F perturbations. Also, during a transition from driving to idling (in the decreasing direction of the purge gas amount), the lower limit of the purge gas amount is raised to suppress the change of the vapor density. This improves the precision of the A/F correction and hence contributes to suppressing A/F perturbations.

Although the preferred embodiments of the present invention have been described above, it will be appreciated that the invention is not limited to the illustrated embodiments. Rather, it will be easy for those skilled in the art to devise various other embodiments.

As described above, according to the present invention, when the density of the fuel vapor emitted from the fuel tank and introduced into the intake passage directly through the solenoid valve is higher than the density of the fuel vapor desorbed from the canister, the duty cycle of the solenoid valve or the amount of change of the duty cycle is limited to within a prescribed range; as a result, the change of the vapor density associated with the change in the purge gas amount is suppressed, or the change in the purge gas amount becomes less. This has the effect of stabilizing the vapor density and hence preventing perturbations in air-fuel ratio when performing control to correct the fuel injection amount in accordance with the purge gas amount.

What is claimed is:

1. A fuel-vapor treatment method for an internal combustion engine equipped with a canister for temporarily adsorbing and storing fuel vapor emitted from a fuel tank for said engine, and a solenoid valve installed in a purge passage communicating between said canister and an intake passage to said engine, for controlling a purge gas amount drawn into said intake passage through said purge passage, wherein the canister is connected to the fuel tank and to the purge passage so that fuel vapor may pass from the fuel tank, into the canister and out of the canister into the purge passage without being adsorbed therein, said method comprising the steps of:

(a) correcting a fuel injection amount in accordance with said purge gas amount;

(b) calculating a purge ratio, the ratio of said purge gas amount to an intake air amount for said engine, in accordance with operating conditions of said engine;

(c) calculating, based on the purge ratio obtained in step (b), the duty cycle of a pulse signal used to control the operation of said solenoid valve;

(d) making a judgement as to whether a first portion of the purge gas, a fuel vapor emitted from said fuel tank and introduced into said intake passage directly through said solenoid valve without being adsorbed in the canister, is in a dense stage as compared to a second portion of the purge gas which is the fuel vapor desorbed from said canister; and (e) limiting the duty cycle calculated in step (c), or the amount of change of said duty cycle, to within a prescribed range when it is judged in step (d) that said first portion of the purge gas is in a dense state.

2. The method according to claim 1, wherein in step (d) the judgement about said dense state is made based on the time elapsed from the start of a purge operation.

3. The method according to claim 1, wherein in step (d) the judgement about said dense state is made based on the amount of the fuel vapor generated from said fuel tank.

4. A fuel-vapor treatment apparatus for an internal combustion engine, comprising:

a canister for temporarily adsorbing and storing fuel vapor emitted from a fuel tank for said engine;

a solenoid valve installed in a purge passage communicating between said canister and an intake passage to said engine, for controlling a purge gas amount drawn into said intake passage through said purge passage, wherein the canister is connected to the fuel tank and to the purge passage so that fuel vapor may pass from the fuel tank, into the canister and out of the canister into the purge passage without being adsorbed therein;

fuel injection correcting means for correcting a fuel injection amount in accordance with said purge gas amount;

purge ratio calculating means for calculating the ratio of said purge gas amount to an intake air amount for said engine, in accordance with operating conditions of said engine;

duty cycle calculating means for calculating, based on the purge ratio calculated by said purge ratio calculating means, the duty cycle of a pulse signal used to control the operation of said solenoid valve;

density difference judging means for making a judgement whether a first portion of the purge gas, a fuel vapor emitted from said fuel tank and introduced into said intake passage directly through said solenoid valve without being adsorbed in the canister, is in a dense stage as compared to a second portion of the purge gas which is the fuel vapor desorbed from said canister; and duty cycle limiting means for limiting the duty cycle calculated by the duty cycle calculating means or the amount of change of said duty cycle, to within a prescribed range when it is judged by said density difference judging means that said first portion of the purge gas is in a dense state.

5. The apparatus according to claim 4, wherein said density difference judging means makes the judgement about said dense state on the basis of the time elapsed from the start of a purge operation.

6. The apparatus according to claim 4, wherein said density difference judging means makes the judgement about said dense state on the basis of the amount of the fuel vapor generated from said tank.

* * * * *

UNITED STATES PATENT AND TRADEMARK OFFICE

CERTIFICATE OF CORRECTION

PATENT NO. : 5,609,142

DATED : March 11, 1997

INVENTOR(S) : Akinori OSANAI

It is certified that error appears in the above-indentified patent and that said Letters Patent is hereby corrected as shown below:

Column 4, line 47, change "pipe 9" to --pipe 19--.

Signed and Sealed this

Twenty-first Day of April, 1998

Bruce Lehman

*Attest:*

BRUCE LEHMAN

*Attesting Officer*

*Commissioner of Patents and Trademarks*